US005442193A

United States Patent [19]

Jaskie et al.

[11] Patent Number: 5,442,193

[45] Date of Patent: Aug. 15, 1995

[54] MICROELECTRONIC FIELD EMISSION DEVICE WITH BREAKDOWN INHIBITING INSULATED GATE ELECTRODE

[75] Inventors: James E. Jaskie; Robert C. Kane, both of Scottsdale, Ariz.

[73] Assignee: Motorola, Schaumburg, Ill.

[21] Appl. No.: 200,036

[22] Filed: Feb. 22, 1994

[51] Int. Cl.[6] ..... H01J 19/24; H01J 1/46; H01J 1/02

[52] U.S. Cl. ..... 257/10; 257/11; 257/632; 257/635; 257/649; 313/309; 313/310; 313/336; 313/351

[58] Field of Search ..... 257/10, 11, 632, 635, 257/649; 313/309, 310, 336, 351

[56] References Cited

U.S. PATENT DOCUMENTS

| | | | |
|---|---|---|---|
| 4,987,377 | 1/1991 | Gray et al. | 313/309 X |
| 5,030,895 | 7/1991 | Gray | 313/309 X |
| 5,038,070 | 8/1991 | Bardai et al. | 313/309 |
| 5,055,077 | 10/1991 | Kane | 313/336 X |
| 5,079,476 | 1/1992 | Kane | 313/351 X |

*Primary Examiner*—William Mintel
*Attorney, Agent, or Firm*—Eugene A. Parsons

[57] ABSTRACT

A field emission device including an electron emitter and a peripherally disposed gate extraction electrode defining a free space region therebetween. The device has an insulating layer substantially isolating the gate extraction electrode from the free space region. The device prevents damaging arc discharge between the electron emitter and gate extraction electrode because of the improved insulation and provides an additional mechanism for electric field enhancement.

7 Claims, 4 Drawing Sheets

MICROELECTRONIC FIELD EMISSION DEVICE WITH BREAKDOWN INHIBITING INSULATED GATE ELECTRODE

FIELD OF THE INVENTION

This invention relates generally to vacuum microelectronic field emission devices and more particularly to an improved field emission device apparatus and method for realization.

BACKGROUND OF THE INVENTION

Vacuum microelectronic field emission devices are known. Prior methods for realization and operation of field emission devices includes forming an electron emitter, for emitting electrons, as a substantially conical/wedge shaped structure disposed within a cavity and having a conductive accelerating electrode disposed peripherally about the cavity. Application of a suitable potential between the accelerating electrode (gate electrode) and the electron emitter will induce electrons to be emitted from the electron emitter. In practice this field emission device electron emitter is operated in concert with a distally disposed anode, for collecting electrons, defining an intervening region therebetween. In order that emitted electrons may arrive at and be collected by the anode the field emission device is operated in an evacuated environment on the order of $10^{-7}$ to $10^{-9}$ Torr. At higher residual pressures, and in the presence of electron emission, substantial ionization of gaseous molecules may take place. Additionally, desorption of contaminants from the surfaces of the electron emitter and the accelerating electrode may provide for a significantly increased local residual gas pressure in the region of the cavity. It is a common shortcoming of known vacuum microelectronic field emission devices that such a local increased residual gas gives rise to destructive breakdown of the field emission device observed as an arc discharge often resulting in a short circuited field emission device and always in the destruction of the electron emitter.

Accordingly, there exists a need for a microelectronic field emission device apparatus and method for realization which overcomes at least some of these shortcomings.

Accordingly, it is a purpose of the present invention to provide an insulated gate field emission device wherein the possibility for gate to electron emitter destructive discharge is removed or substantially reduced.

It is a further purpose of the present invention to provide an insulated gate field emission device wherein a previously unknown electric field enhancement mechanism is provided.

SUMMARY OF THE INVENTION

These needs and others and the above stated purposes and others are substantially met through provision of a field emission device including an electron emitter and a peripherally disposed gate extraction electrode defining a free space region therebetween and wherein the gate extraction electrode is substantially insulated from the free space region by an insulating layer disposed thereon.

This need and others and the above stated purposes and others are further met through provision of a method for forming a field emission device including the steps of providing a supporting substrate having a major surface and depositing a first insulating layer on the major surface of the supporting substrate, a conductive layer onto the first insulating layer, and a second insulating layer onto the conductive layer. A mask layer is deposited and selectively patterned onto the second insulating layer and a first directed etch is performed to remove some of the material of the first and second insulating layers and some of the material of the conductive layer such that a cavity is defined, after which the mask layer is removed. A substantially conformal deposition is performed of an insulating layer, which insulating layer in concert with the remaining second insulating layer comprises a third insulating layer. A second directed etch is performed to remove some of the material of the third insulating layer and to expose a part of the major surface of the supporting substrate, after which an electron emitter is deposited in the cavity and on and operably coupled to the major surface of the supporting substrate, such that the remaining material of the third insulating layer substantially insulates the conductive layer from a free space region defined between the conductive layer and the electron emitter.

DETAILED DESCRIPTION OF THE DRAWINGS

Figure 1:
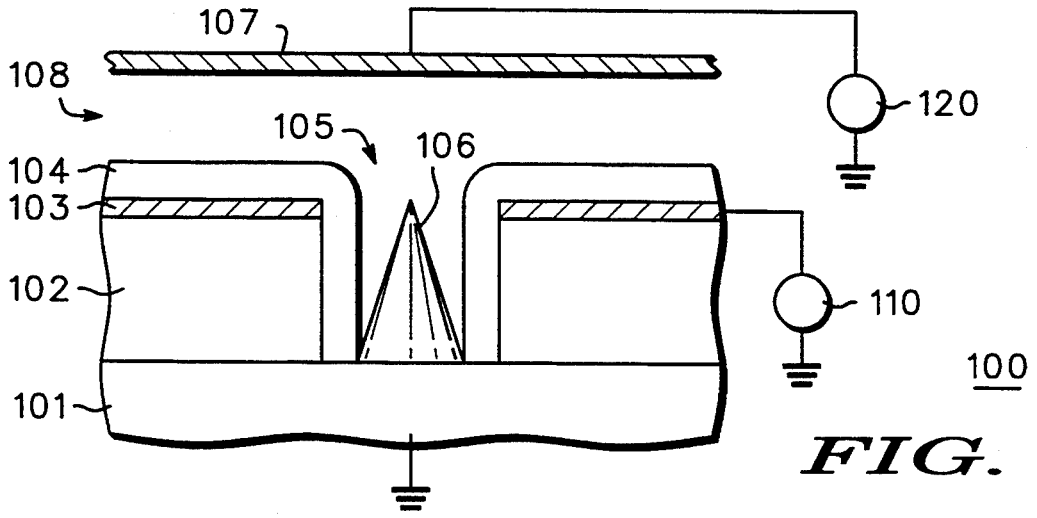
FIG. 1 is a side elevational cross-sectional representation of an embodiment of an improved field emission device apparatus with insulated extraction electrode in accordance with the present invention.

A cross-sectional representation of an embodiment of a microelectronic field emission device 100, in accordance with the present invention, is illustrated in FIG. 1. A supporting substrate 101, having a major surface, is provided. A first insulating layer 102 is disposed on the major surface of substrate 101 and a conductive layer 103 is disposed on the first insulating layer 102. It should be understood that conductive layer 103 may be formed of either conductive or semiconductive material and the term "conductive" is used throughout this disclosure to indicate either. The conductive layer is utilized as a gate extraction electrode 103, as will become apparent presently. Insulating layer 102 and the conductive layer (electrode 103) have an aperture (cavity) 105 defined therethrough. A second insulating layer 104 is disposed on the conductive layer (electrode 103) and on a part of insulating layer 102 and the major surface of supporting substrate 101 within cavity 105. An electron emitter 106 is disposed within cavity 105 and on and operably coupled to the major surface of supporting substrate 101. An anode 107 is distally disposed with respect to electron emitter 106 and defines an interspace region 108 therebetween.

For the embodiment now depicted operation is effected by placing microelectronic field emission device 100 within an evacuated environment and operably coupling suitable potentials thereto. As depicted in FIG. 1, a first externally provided potential source 110 is operably connected between gate electrode 103 and a reference potential (herein depicted as ground reference) and a second externally provided potential source 120 is operably connected between the anode 107 and the reference potential. Further, supporting substrate 101 is operably connected to the reference potential.

In anticipated embodiments not shown, microelectronic field emission device 100 may employ a conductive layer disposed on the major surface of substrate 101, wherein electron emitter 106 would be disposed on the conductive layer and the conductive layer would be operably coupled to the reference potential. Also, it is known that pluralities of field emission devices are commonly employed in arrays to realize a field emission device apparatus. The depictions of this disclosure are representative of such arrays of pluralities of field emission devices.

Insulating layer 104 provides an effective molecular impermeable envelope about gate extraction electrode 103. As such, residual gas constituents, which may be partially comprised of desorbed surface contaminants and non-evacuated atmospheric gases and which generally reside within a free space region defined between gate extraction electrode 103 and electron emitter 106, are impeded from residing in cavity 105 near gate extraction electrode 103. Insulating layer 104 effectively establishes a barrier to prevent destructive arc discharges between gate extraction electrode 103 and electron emitter 106.

Microelectronic field emission device 100 operates on the principle of electric field enhancement at a region of electron emitter 106 which presents a geometric discontinuity of small radius of curvature. For field emission device 100 of the present disclosure such a region is the apex of the conical/wedge shaped electron emitter 106. An electric field, provided by potentials applied to various electrodes of field emission device 100, are enhanced by the geometry of electron emitter 106. By providing insulating layer 104, having a relative dielectric constant greater than unity and having a thickness, within cavity 105 the electric field near electron emitter 106 is further proportionately increased to provide a previously unknown mechanism for increased electric field enhancement.

Figure 2:
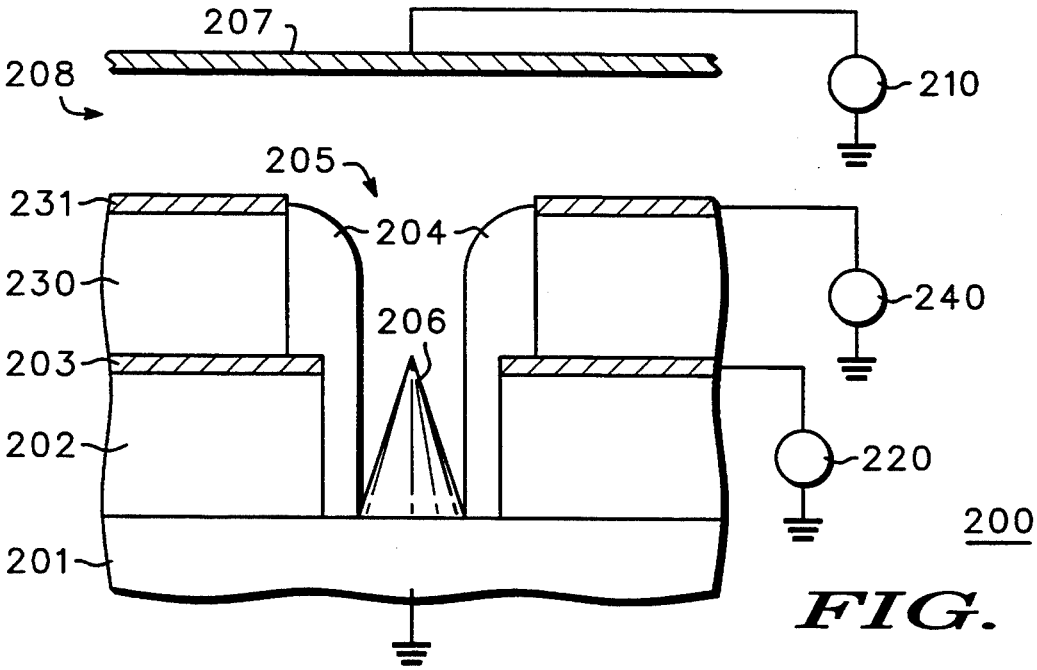
FIG. 2 is a side elevational cross-sectional representation of another embodiment of an improved field emission device de apparatus with insulated extraction electrode in accordance with the present invention.

A cross-sectional representation of another embodiment of an improved field emission device 200 employing an insulated gate extraction electrode 203 in accordance with the present invention is illustrated in FIG. 2. In FIG. 2, drawing features corresponding to those previously described with reference to FIG. 1 are similarly referenced beginning with the numeral "2". FIG. 2 further depicts a third insulating layer 230 disposed on gate extraction electrode 203 and a second conductive layer 231 disposed on insulating layer 230. A third externally provided potential source 240 is operably connected between conductive layer 231 and the reference potential.

Operation of microelectronic field emission device 200 is similar to that of microelectronic field emission device 100 described previously with reference to FIG. 1. The provision of second conductive layer 231 provides for preferred deflection of emitted electrons which traverse an interspace region 208 to be subsequently collected at an anode 207.

As described previously, provision of a second insulating layer 204 effectively shields gate extraction electrode 203 from any residual gas constituents and precludes the possibility of a destructive arc discharge between gate extraction electrode 203 and an electron emitter 206. Insulating layer 204 further provides for a proportionate increase in the magnitude of the enhanced electric field at the apex of electron emitter 206 due to a relative dielectric constant which may be greater than unity.

FIGS. 3 through 6 are cross-sectional representations of partial structures realized by performing various steps of a method for forming an embodiment of a microelectronic field emission device in accordance with the present invention.

Figure 3:
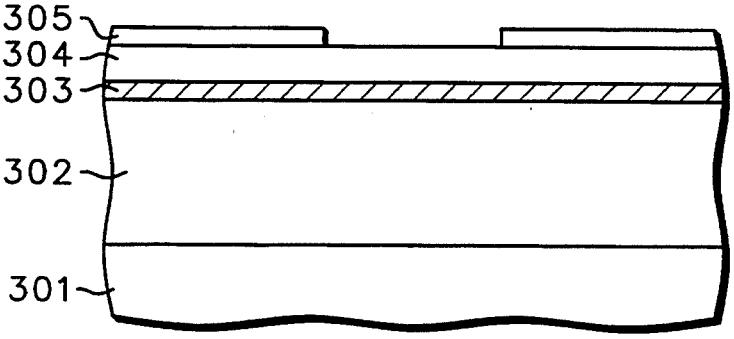
FIGS. 3–6 are side elevational cross-sectional representations of partial structures realized by performing various steps of a method for forming an embodiment of an improved field emission device apparatus with insulated extraction electrode in accordance with the present invention.

A supporting substrate 301 having a major surface is depicted in FIG. 3. A first insulating layer 302 is deposited onto the major surface and a conductive layer 303 is deposited onto insulating layer 302. A second insulating layer 304 is deposited onto conductive layer 303. A selectively patterned mask layer 305 is deposited onto insulating layer 304. The deposition of layers 302 through 305 can be performed by any of many known techniques including, for example, some of chemical vapor deposition (CVD), electron-beam evaporation, sputtering, plasma enhanced CVD, ion-beam evaporation, and spin-on deposition.

Figure 4:
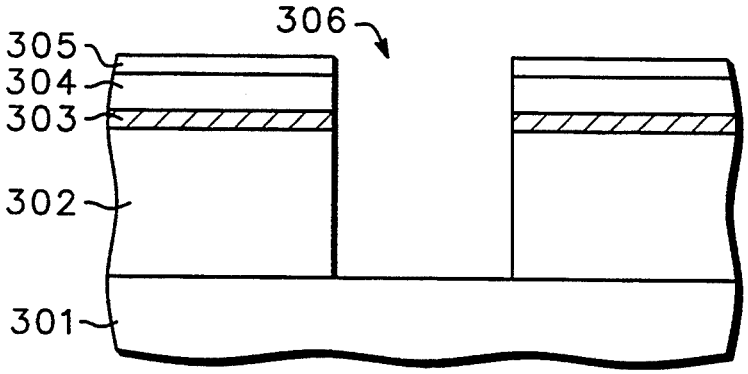

A cross sectional representation of the structure of FIG. 3 is illustrated in FIG. 4 after having undergone an additional step of the method. The additional step includes performing a first directed etch step to selectively remove some of the material of first and second insulating layers 302 and 304 and some of the material of conductive layer 303 such that a part of the major surface of supporting substrate 301 is exposed and defines a cavity 306. The directed etch step can be effected by known techniques such as, for example, a reactive ion etch (RIE).

Figure 5:
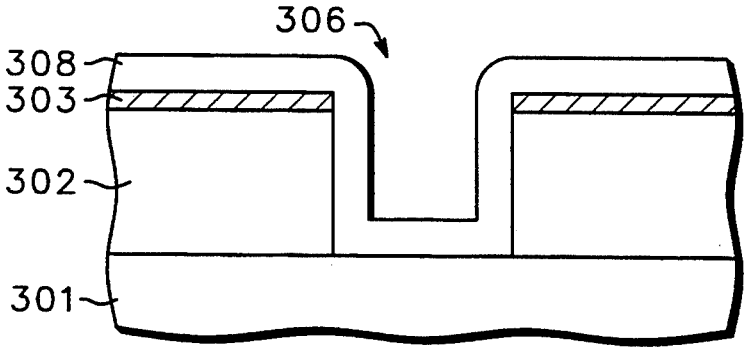

A cross sectional representation of the structure described with reference to FIG. 4 is depicted in FIG. 5 after having undergone additional steps of the method. The additional steps include removing mask layer 305 and performing a substantially conformal deposition of an insulating layer which layer in concert with the remaining second insulating layer 304 comprises a third insulating layer 308. As depicted, insulating layer 308 is deposited on conductive layer 303, a part of insulating layer 302, and the exposed part of the major surface of supporting substrate 301.

Figure 6:
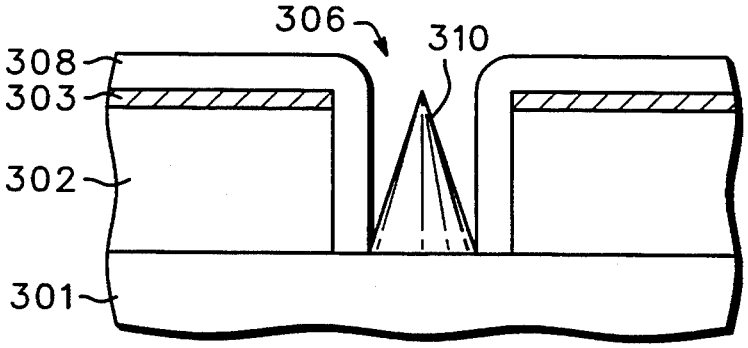

A cross sectional representation of the structure described previously with reference to FIG. 5 is illustrated in FIG. 6 after having undergone additional steps of the method. The additional steps include performing a second directed etch (such as an RIE) to remove some of insulating layer 308 and expose a part of the major surface of supporting substrate 301. Here it should be noted that the provision of a substantial additional quantity or thickness of insulating layer 308 on the upper surface of conductive layer 303 allows the second directed etch to be performed while maintaining a sufficient thickness of insulative material on the upper surface of conductive layer 303. Subsequent to the second directed etch step, an electron emitter 310 is deposited in cavity 306 and on and operably coupled to the major surface of supporting substrate 301.

By performing the steps of the method described with reference to FIGS. 3–6 a microelectronic field emission device having an insulated gate extraction electrode (conductive layer 303) is realized. The resulting insulated gate field emission device is an improvement over prior field emission devices since the possibility for gate to electron emitter destructive discharge is removed and a previously unknown electric field enhancement mechanism is provided.

FIGS. 7 through 12 are cross-sectional representations of partial structures realized by performing various steps of another method for forming another embodiment of a microelectronic field emission device in accordance with the present invention.

Figure 7:
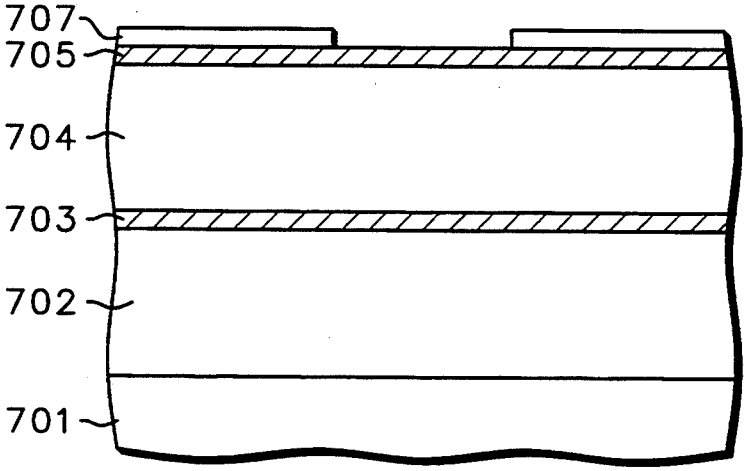
FIGS. 7–12 are side elevational cross-sectional representations of partial structures realized by performing various steps of another method for forming an embodiment of an improved field emission device apparatus with insulated extraction electrode in accordance with the present invention.

A supporting substrate 701 having a major surface is depicted in FIG. 7. A first insulating layer 702 is deposited onto the major surface of supporting substrate 701 and a first conductive layer 703 is deposited onto insulating layer 702. A second insulating layer 704 is deposited onto conductive layer 703. A second conductive layer 705 is deposited onto insulating layer 704. A selectively patterned mask layer 707 is deposited onto conductive layer 705. The depositions of the layers 702 through 707 can be performed by any of many known techniques including, for example, some of chemical vapor deposition (CVD), electron-beam evaporation, sputtering, plasma enhanced CVD, ion-beam evaporation, and spin-on deposition.

Figure 8:
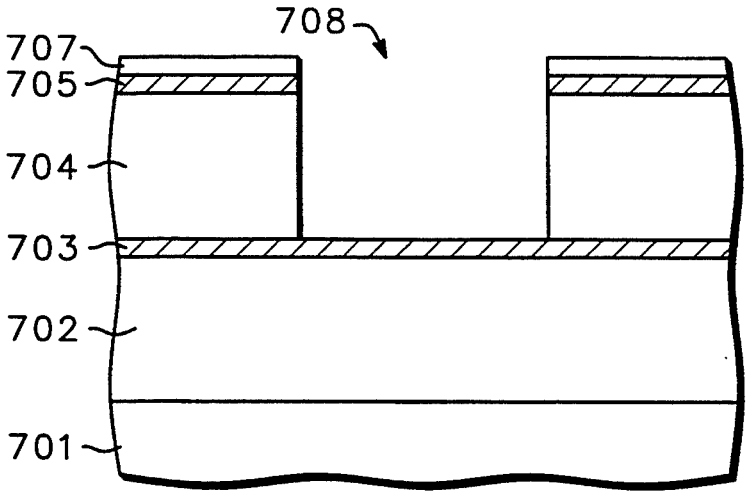

The structure described with reference to FIG. 7 is depicted in FIG. 8 after having undergone an additional step of the method. In the additional step, a first directed etch such as, for example, a reactive ion etch is performed to remove some of the material of conductive layer 705 and insulating layer 704, thereby defining a first aperture 708 therethrough and exposing a part of conductive layer 703.

Figure 9:
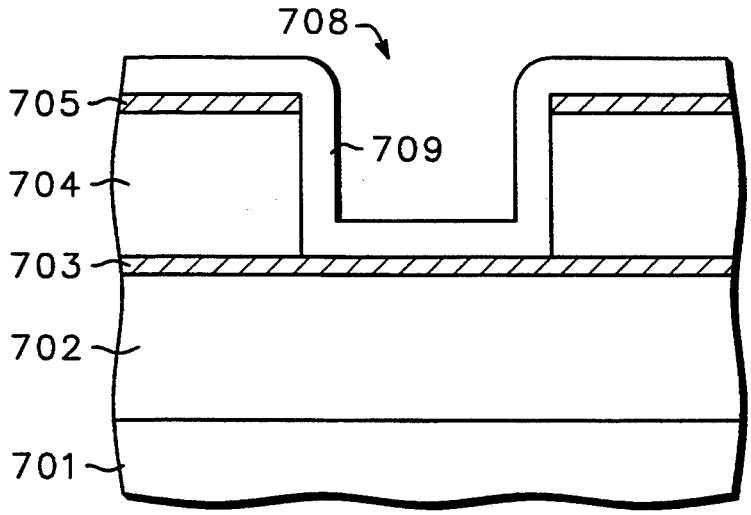

The structure described previously with reference to FIG. 8 is depicted in FIG. 9 after having undergone additional steps of the method. The additional steps include removing mask layer 707 and substantially conformally depositing a third insulating layer 709 onto conductive layer 705 and, at least partially within aperture 708, onto insulating layer 704 and the exposed part of conductive layer 703.

Figure 10:
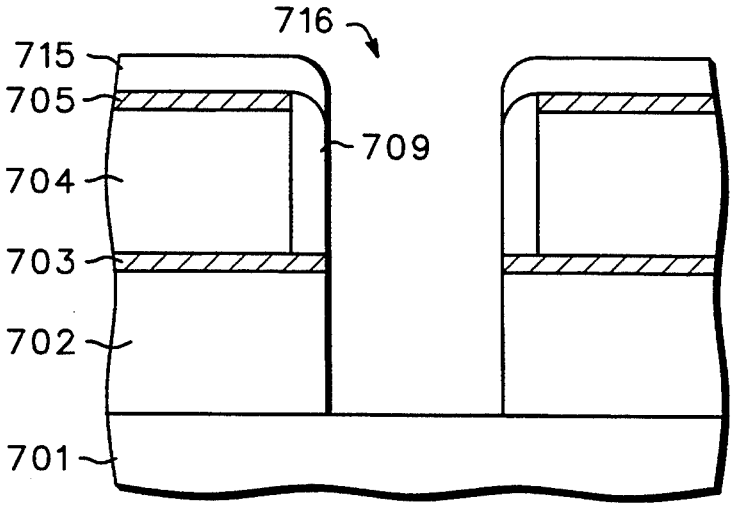

The structure first described with reference to FIG. 9 is depicted in FIG. 10 after having undergone additional steps of the method. The additional steps include performing a second directed etch to remove some of the material of insulating layer 709, leaving only sidewalls within aperture 708. Subsequent to the second directed etch, a hard mask 715 comprised of, for example and not limited to, one or more of gold, chromium, and aluminum is selectively deposited. A third directed etch such as, for example, an RIE is then performed to remove some of the material of conductive layer 703 and some of the material of insulating layer 702 such that at least a part of the major surface of supporting substrate 701 is exposed. The third directed etch step defines a cavity 716 which is substantially coaxial with cavity 708 but extends to the major surface of supporting substrate 701. The selective deposition of hard mask 715 is performed, for example, by performing a low angle material evaporation wherein material is substantially deposited only onto conductive layer 705 and a part of insulating layer 709 but substantially no deposition occurs within aperture 808.

Figure 11:
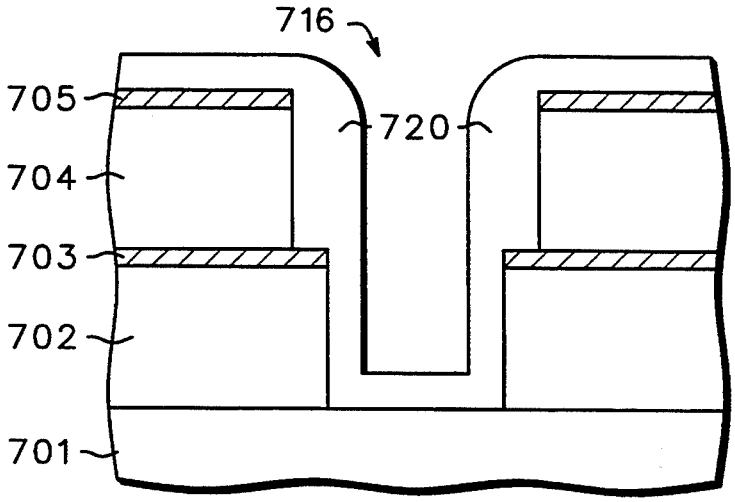

The structure described above with reference to FIG. 10 is depicted in FIG. 11 after having undergone additional steps of the method. The additional steps include removing hard mask 715 and performing a second substantially conformal deposition of insulating material which insulating material in concert with insulating layer 709 comprises a fourth insulating layer 720. Insulating layer 720 is deposited on conductive layer 705, insulating layer 709, conductive layer 703, insulating layer 702, and the exposed major surface of supporting substrate 701 within cavity 716.

Figure 12:
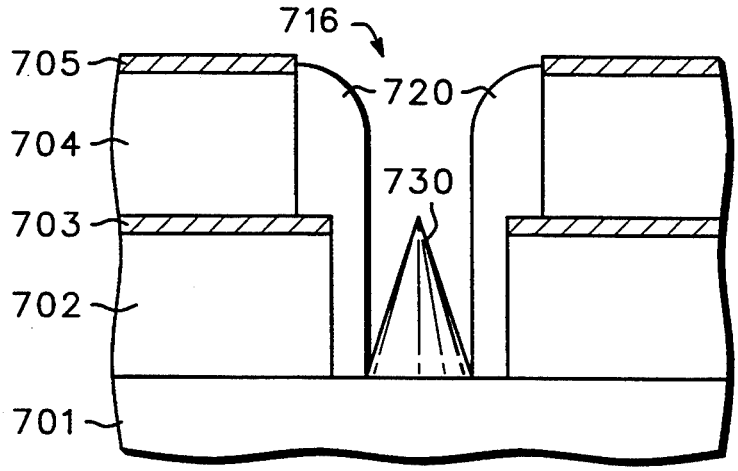

The structure described previously with reference to FIG. 11 is depicted in FIG. 12 after having undergone additional steps of the method. The additional steps include performing a third directed etch to remove some of the material of insulating layer 720 such that a part of the major surface of supporting substrate 701 is exposed. Subsequent to the third directed etch step an electron emitter 730 is deposited within cavity 716 and onto and operably coupled to the major surface of supporting substrate 701.

By performing the steps of the method described with reference to FIGS. 7 through 12 a microelectronic field emission device with integrally formed electron beam deflection electrode (conductive layer 705) having an insulated gate extraction electrode (conductive layer 703) is realized. The insulated gate field emission device of the present invention is an improvement over prior field emission devices since the possibility for gate to electron emitter destructive discharge is removed and a previously unknown electric field enhancement mechanism is provided.

What is claimed is:

1. A field emission device comprised of an electron emitter and a peripherally disposed gate extraction electrode defining a free space region therebetween and wherein the gate extraction electrode is insulated from the free space region by an insulating layer disposed thereon, the insulating layer being disposed between the gate extraction electrode and the free space region.

2. A field emission device comprising:

a supporting substrate having a major surface;

a first insulating layer disposed on the major surface;

a conductive layer disposed on the first insulating layer;

a cavity defined through the conductive layer and the first insulating layer and exposing a part of the major surface of the supporting substrate, the cavity defining a gate extraction electrode in the conductive layer and a free space region within the cavity;

a second insulating layer disposed on the conductive layer, a part of the first insulating layer, and the exposed major surface of the supporting substrate, the second insulating layer being disposed between the gate extraction electrode and the free space region; and an electron emitter, for emitting electrons, disposed within the free space region within the cavity and on and operably coupled to the major surface of the supporting substrate, such that the second insulating layer insulates the conductive layer from the free space region between the gate extraction electrode and the electron emitter to impede the occurrence of destructive arc discharge and to provide a mechanism for increased electric field enhancement at the electron emitter.

3. A field emission device as claimed in claim 2 and further including an anode distally disposed with respect to the electron emitter and defining an interspace region between the electron emitter and the anode.

4. A field emission device as claimed in claim 3 and further including a first externally provided potential source operably coupled between the gate extraction electrode and a reference potential, a second externally provided potential source operably coupled between the anode and the reference potential, and an operable connection of the supporting substrate to the reference potential, such that upon application of suitable potentials to the anode and gate extraction electrodes by second and first externally provided potential sources, respectively, electrons are emitted from the electron emitter to traverse the extent of the interspace region and subsequently be collected by the anode.

5. A field emission device comprised of:

a supporting substrate having a major surface;

a first insulating layer disposed on the major surface;

a first conductive layer disposed on the first insulating layer;

a second insulating layer disposed on the first conductive layer;

a second conductive layer disposed on the second insulating layer;

a cavity defined through the second conductive layer, the second insulating layer, the first conductive layer and the first insulating layer and exposing the major surface of the supporting substrate within the cavity, the cavity defining a gate extraction electrode in the first conductive layer and an electron deflection electrode in the second conductive layer;

a third insulating layer disposed on the second insulating layer, the first conductive layer, the first insulating layer and a part of the exposed major surface of the supporting substrate within the cavity; and an electron emitter, for emitting electrons, disposed within the cavity and on and operably coupled to the major surface of the supporting substrate, such that the third insulating layer substantially insulates the first conductive layer from a free space region between the gate extraction electrode and the electron emitter to impede the occurrence of destructive arc discharge and to provide a mechanism for increased electric field enhancement at the electron emitter.

6. A field emission device as claimed in claim 5 and further including an anode, distally disposed with respect to the electron emitter and defining an interspace region between the electron emitter and the anode.

7. A field emission device as claimed in claim 6 and further including a first externally provided potential source operably coupled between the gate extraction electrode and a reference potential;

a second externally provided potential source operably coupled between the anode and the reference potential;

a third externally provided potential source operably coupled between the electron deflection electrode and the reference potential; and an operable connection of the supporting substrate to the reference potential, such that upon application of suitable potentials to the anode, electron deflection electrode, and gate extraction electrode by second, third, and first externally provided potential sources, respectively, electrons are emitted from the electron emitter to traverse the extent of the interspace region and subsequently be collected by the anode.

* * * * *